US006293717B1

(12) United States Patent
Kurashina

(10) Patent No.: US 6,293,717 B1
(45) Date of Patent: Sep. 25, 2001

(54) TAPE PRINTING APPARATUS AND TAPE PRINTING METHOD

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/645,189

(22) Filed: Aug. 24, 2000

(30) Foreign Application Priority Data

Aug. 26, 1999 (JP) ..... 11-239282

(51) Int. Cl.[7] ..... B41J 11/26; B41J 3/42

(52) U.S. Cl. ..... 400/615.2; 400/76; 400/70; 400/61

(58) Field of Search ..... 400/615.2, 76, 400/70, 61

(56) References Cited

U.S. PATENT DOCUMENTS 6,129,467 * 10/2000 Toyosawa et al. ..... 400/615.2

* cited by examiner

*Primary Examiner*—John S. Hilten
*Assistant Examiner*—Charles H. Nolan, Jr.
(74) *Attorney, Agent, or Firm*—Hogan & Hartson, L.L.P.

(57) ABSTRACT

In a tape printing apparatus, a tape width of a tape is detected, and a reduced tape width is calculated by reducing the detected tape width at a predetermined reduction ratio. At the same time, a character string is also reduced at the predetermined reduction ratio, whereby a reduced character string is produced. Then, a pair of parallel lines indicative of the reduced tape width and the reduced character string are printed on the tape in a manner such that a positional relationship between the pair of parallel lines and the reduced character string agrees with a positional relationship between the tape and the character string in normal print.

11 Claims, 5 Drawing Sheets

TAPE PRINTING APPARATUS AND TAPE PRINTING METHOD

BACKGROUND OF THE INVENTION

1. Field of the Invention

This invention relates to a tape printing apparatus and method that is capable of performing a preview print which enables the user to gain prior information about a print image to be obtained as an ultimate result of printing.

2. Prior Art

In recent years, there have been widely used tape printing apparatuses of a type which has a "preview display" capability of displaying an image of an entered character string so as to allow the user to gain prior information about a print image of the character string to be obtained as an ultimate result of printing of the same. In a tape printing apparatus of this type, data similar to print data is formed for use in display, and then "preview display" is performed based on the data. In general, tape printing apparatuses have a small display area on a display screen, so that when a long character string is entered, or when a tape width is wide, not the whole of an image of the character string but only part of the same is displayed. Therefore, in order to check on the whole of the image, it is required to scroll the image manually by using cursor keys or the like, or automatically without using any cursor keys or the like, as shown in FIG. 5. Further, some tape printing apparatuses have a capability of displaying an image of a character string by reducing the size of the image, dependent on its length or the like, as shown in FIG. 6, so as to allow the largest possible area of the print image to be viewed.

However, the above tape printing apparatuses suffers from the following problems: In the case of the FIG. 5 example, only part of the print image can be displayed at a time, and hence it is required to scroll the print image, so that it takes time to check the whole of the image, and an overall image of the entered character string cannot be readily obtained by the user. Further, in the case of the FIG. 6 example, although a relatively large area of the print image can be viewed at a glance because the size of the image is reduced, small fonts are inevitably defaced if the display is low in resolution, which makes fine portions of the character image difficult to read.

SUMMARY OF THE INVENTION

It is an object of the invention to provide a tape printing apparatus and method that enables the user to quickly gain clear-cut prior information about a print image to be obtained as an ultimate result of printing.

To attain the above object, according to a first aspect of the invention, there is provided a tape printing apparatus that is capable of performing a normal print in which an entered character string is printed in a predetermined size on a tape as a print medium.

The tape printing apparatus according to the first aspect of the invention is characterized by comprising:

tape width-detecting means for detecting a tape width of the tape;

reduction means for determining a reduced tape width by reducing the detected tape width at a predetermined reduction ratio and for forming a reduced character string by reducing the character string at the predetermined reduction ratio; and preview print means for printing a pair of parallel lines indicative of the reduced tape width and the reduced character string on the tape in a manner such that a positional relationship between the pair of parallel lines and the reduced character string agrees with a positional relationship between the tape and the character string in the normal print.

According to this tape printing apparatus, the tape width-detecting means detects a tape width of a tape, the reduction means calculates a reduced tape width by reducing the tape width at a predetermined reduction ratio and at the same time reduces a character string at the predetermined reduction ratio to thereby produce a reduced character string, and the preview print means prints a pair of parallel lines indicative of the reduced tape width and the reduced character string on the tape in a manner such that a positional relationship between the pair of parallel lines and the reduced character string agrees with a positional relationship between the tape and the character string in the normal print. That is, in "preview print", a character string to be printed in normal print and a tape width required for the normal print are reduced at an identical reduction ratio and printed on a tape, so that it is possible for the user to gain information of the whole of an image at a glance, which is as clear as possible and close to a final print image as an ultimate result of the normal print.

Preferably, the tape printing apparatus further comprises tape length-setting means for setting a tape length; and the reduction means further determines a reduced tape length by reducing the tape length set by the tape length-setting means at the predetermined reduction ratio; and the preview print means prints on the tape the pair of parallel lines indicative of the reduced tape width as upper and lower sides of a rectangle enclosing the reduced character string and a pair of parallel lines indicative of the reduced tape length as right and left sides of the rectangle.

According to this preferred embodiment, the tape length-setting means sets a tape length and further calculates a reduced tape length by reducing the tape length set by the tape length-setting means at the predetermined reduction ratio. Then, the preview print means prints on the tape the pair of parallel lines indicative of the reduced tape width as upper and lower sides of a rectangle enclosing the reduced character string and a pair of parallel lines indicative of the reduced tape length as right and left sides of the rectangle. That is, through the "preview prints", the two pairs of parallel lines indicative of the tape width and the tape length, which are drawn horizontally and vertically, respectively, are printed on the tape as a rectangle enclosing the reduced character string, so that it is possible for the user to gain clearer information of the final print image including the layout of the character string on the tape.

More preferably, the tape printing apparatus further comprises color-setting means for setting colors of the character string and a background thereof; and when the normal print is to be performed in color based on settings by the color-setting means, the preview print is performed with a color arrangement identical to a color arrangement in the normal print.

According to this preferred embodiment, a preview print is performed with a color arrangement identical to a color arrangement in normal print, so that when the final print image is to be printed in color, the preview print is also performed in color, thereby enabling the user to gain information not only of the layout of the final print image, but also of the coloration of the same.

Alternatively, the tape printing apparatus further comprises color-setting means for setting colors of the character string and a background thereof; and when the normal print is to be performed in color based on settings by the color-setting means, colors in the normal print are monochromatically printed in gray tones in the preview print.

According to this preferred embodiment, since colors in the normal print are monochromatically printed in gray tones in the preview print, consumption of color inks by the "preview print" can be reduced.

Preferably, the preview print is performed with a lower print density and at a higher printing speed than the normal print is.

According to this preferred embodiment, since the "preview print" is performed with a lower print density than the "normal print" is, consumption of energy can be reduced. Further, when an ink jet printing method is employed, consumption of ink can also be reduced. Moreover, since the preview print is performed at a high speed, it is possible for the user to quickly gain prior information about the final print image.

To attain the above object, according to a second aspect of the invention, there is provided a method of performing a preview print of an entered character string on a tape as a print medium, comprising the steps of:

detecting a width of the tape;

determining a reduced tape width by reducing the detected tape width at a predetermined reduction ratio;

forming a reduced character string by reducing the character string at the predetermined reduction ratio; and printing a pair of parallel lines indicative of the reduced tape width and the reduced character string on the tape in a manner such that a positional relationship between the pair of parallel lines and the reduced character string agrees with a positional relationship between the tape and the character string printed in a predetermined size on the tape.

According to this tape printing method, since a character string to be printed in normal print and a tape width are reduced at an identical reduction ratio and then printed on a tape by "preview prints", it is possible for the user to gain information of the whole of an image at a glance, which is as clear as possible and close to a final print image as an ultimate result of normal print.

The above and other objects, features, and advantages of the invention will become more apparent from the following detailed description taken in conjunction with the accompanying drawings.

DETAILED DESCRIPTION

Figure 1:
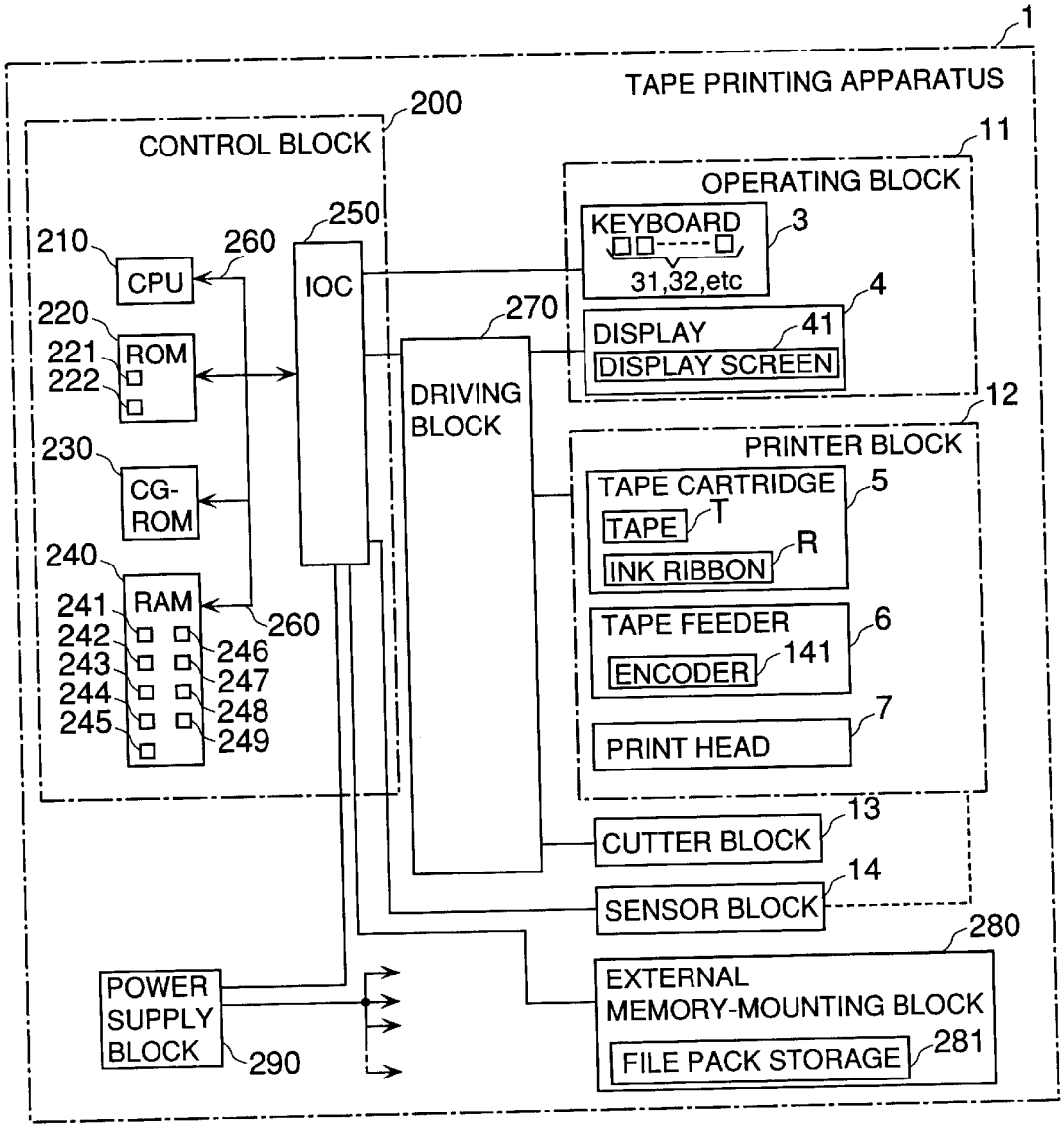
FIG. 1 is a block diagram showing the arrangement of a control system of a tape printing apparatus according to an embodiment of the invention.

The invention will now be described in detail with reference to the drawings showing a tape printing apparatus and method according to an embodiment thereof. Referring first to FIG. 1, there is shown the arrangement of the control system of the tape printing apparatus.

The tape printing apparatus 1 is capable of carrying out color printing of a print image on a tape T by a thermal printing method as well as cutting off the printed portion of the tape T to thereby produce a label. The print image is formed based on desired letters and the like entered via a keyboard of the apparatus 1.

The tape T is comprised of a substrate tape, an adhesive layer coated on an underside surface of the substrate tape, and a release paper tape affixed to the adhesive layer. The substrate tape is formed of a material which is capable of readily absorbing ink, such as paper, paper with a coated layer or a film with a coated layer. The adhesive layer is used for affixing a printing tape as a label to an object article, such as a file, while the release paper tape is used for preventing dust or dirt from depositing on the adhesive layer. Tape cartridges are provided which contain various kinds of tapes T with various tape widths of 4.5 mm to 48 mm. A print image having a resolution of 24 to 1024 dots in the direction of the width thereof is printed on the tape T, dependent on the width of the tape. It should be noted that there are provided still other tapes T different in material or having background colors other than white. Therefore, it is possible to use at least several tens of kinds of tapes T including ones to be adopted in the future.

As shown in FIG. 1, the tape printing apparatus 1 is basically comprised of an operating block 11 which includes the keyboard 3 and a display 4 and provides interfaces between the apparatus 1 and the user, a printer block 12 which includes a tape cartridge 5 removably mounted in the apparatus 1, a print head 7 of a thermal type, and a tape feeder 6, referred to hereinafter, and prints on a tape T fed from the tape cartridge 5 by the print head 7, a cutter block 13 for cutting off the printed portion of the tape T, a sensor block 14 having various sensors for carrying out various detecting operations, a driving block 270 having various drivers for driving circuits of blocks and devices, an external memory-mounting block 280 for removably mounting an external memory 281 (called "file pack storage") therein, a power supply block 290, and a control block 200 for controlling operations of components of the tape printing apparatus 1 including the above-mentioned sensors and drivers. To implement the above construction, a casing of the apparatus 1 accommodates a circuit board, not shown, in addition to the printer block 12, the cutter block 13, the sensor block 14, the external memory-mounting block 280, and so forth. On the circuit board are mounted the power supply block 290 and the circuits of the driving block 270 and the control block 200. A power supply unit of the power supply block 290 is connected to a connector socket 24 connectable with an AC adapter, and a battery, such as a nicad battery, removably mounted from the outside of the apparatus casing, so as to supply power to the components of the tape printing apparatus 1.

Although illustration and indication of each component are omitted, the printer block 12 has the tape cartridge 5 containing the tape T and an ink ribbon R within a cartridge casing thereof. The tape cartridge 5 has a through hole for receiving therein a head unit arranged in a compartment of the printer block. The tape cartridge 5 contains a tape reel for receiving therein a positioning pin arranged in the compartment, and a ribbon take-up reel for receiving therein a ribbon take-up reel-driving shaft arranged in the compartment. Further, a platen roller is arranged within the tape cartridge at a location where the tape T and the ink ribbon R overlap, for receiving therein a platen drive shaft arranged in the compartment such that the platen roller faces toward the print head (thermal head) 7 incorporated in the head unit.

The tape cartridge 5 has a plurality of small holes formed in the bottom thereof for discrimination of the type of tape T contained therein from the other types of the tape T having different widths, which are contained in other tape cartridges 5. A tape-discriminating sensor, not shown, comprised e.g. of micro-switches is arranged in the compartment, for detecting these holes to thereby determine the type of tape T contained in the tape cartridge. Further, the compartment is provided with an ambient temperature sensor, such as a thermistor, which sends information of an ambient temperature detected thereby to the control block 200. Further, ahead surface temperature sensor formed e.g. by a thermistor, is arranged on a surface of the print head 7 in a manner intimately contacting the surface, which sends information of the surface temperature of the thermal head 7 detected thereby to the control block 200. The apparatus casing is formed with a tape exit which communicates between the compartment and the outside of the apparatus. On the tape exit faces a tape cutter for cutting off a dispensed portion of the tape T.

When the tape cartridge 5 is mounted in the compartment, the through hole of the tape cartridge 5 receives therein the head unit, the tape reel receives therein the positioning pin, the platen roller receives therein the platen drive shaft, and the ribbon take-up reel receives therein the ribbon take-up reel drive shaft, which enables the feed of the tape T and the ink ribbon R. Further, in the above state, the print head 7 is brought into contact with the platen roller in a manner sandwiching the tape T and the ink ribbon R therebetween, whereby the apparatus is ready for a printing operation. When the tape T is rolled out from the tape reel, the ink ribbon R is also rolled out from the ribbon reel and fed or run together with the tape T in a state lying upon the tape T, followed by being taken up by the ribbon take-up reel. That is, the platen roller and the ribbon take-up reel are rotated in synchronism with each other, whereby the tape T and the ink ribbon 18 are simultaneously fed, and at the same time the print head 7 is driven in synchronism with running of the tape T and the ink ribbon R to thereby carry out printing.

In the tape printing apparatus 1, the user, after mounting the tape cartridge 5 in the compartment of the printer block 12, enters printing information of a print image, such as desired characters (letters, numerals, symbols, figures and the like), via the keyboard 3, while verifying results of the entry on the display 4, or edits the entered printing information. Thereafter, when the user instructs a printing operation via the keyboard 3, the tape feeder 6 of the printer block 12 is driven to unwind the tape T from the tape cartridge 5, and at the same time the print head 7 is driven to print characters on the tape T as desired. The printed portion of the tape T is delivered from the tape exit, as the printing operation proceeds. After the desired characters have been printed in the above manner, the platen roller continues to rotate for a predetermined time period (the ribbon take-up reel also continues to rotate in synchronism with rotation of the platen roller), whereby the tape T continues to be fed until a predetermined cutting position on the tape T, which is adapted to a tape length including the length of a marginal area, reaches a point corresponding to a location of the tape cutter.

The tape feeder 6 of the printer block 12 is arranged in a space extending from a lateral side of the compartment to a bottom side of the same, and rotates the platen drive shaft and the ribbon take-up reel drive shaft by using a tape feedmotor (TF motor) arranged as a power (drive) source at a location latterly outward of the compartment. The tape feeder 6 includes the TF motor, the platen drive shaft, the ribbon take-up reel drive shaft, a reduction gear train for transmitting part of the driving force of the TF motor to each drive shaft, and a chassis for supporting them thereon.

Further, the TF motor according to the present embodiment is implemented by a DC motor, and the tape feeder 6 of the printer block 12 further includes an encoder 141 for detecting the number of rotations of the TF motor (DC motor). The encoder 141 is comprised of a disc, not shown, which is formed with four detection openings along a periphery thereof and rigidly fixed to an end of the main shaft of the DC motor, and a rotational speed sensor, not shown, which is comprised of a photo sensor which faces the detection openings of the disk sequentially, and a sensor circuit board supporting the photo sensor thereon and carries out photoelectric conversion in cooperation with the photo sensor. The photo sensor has a light-emitting element and a light-receiving element arranged in a manner opposed to each other. Light emitted from the light-emitting element passes through the detection openings (arranged along the periphery) of the disk and is received by the light-receiving element whereby the number of rotations of the DC motor (the number of pulses corresponding to the number of turns of the DC motor is generated). In other words, the on-off of the light received from the light-emitting element by the light-receiving element is photoelectrically converted by the sensor circuit board and output as a pulse signal to the control block 200. Of course, the above TF motor can also be constructed by a stepping motor (pulse motor) to omit the encoder 141 such that the tape T can be fed with ease by a predetermined number of steps based on the pulse signal.

In FIG. 1, for convenience of description, it is assumed that the sensor block 14 includes the tape-discriminating sensor, the ambient temperature sensor, the head surface temperature sensor, and the rotational speed sensor, described hereinabove. The sensor block 14 generates signals indicative of a sensed type of a tape, ambient temperature, head surface temperature, and rotational speed. These signals are reported or delivered to the control block 200. It should be noted that in the sensor block 14 can be provided other sensors, such as a voltage sensor which is connected to the power supply unit of the power supply block 290 that supplies power to the components of the tape printing apparatus 1, for detecting changes in the electric potential of the power supply unit, and the like, or some of the above sensors, such as the encoder 141 in the case of the TF motor being the pulse motor, can be omitted to suit the actual requirements of the apparatus.

Next, the cutter block 13 includes a tape cutter and a cutter motor for driving the tape cutter for cutting operations. When the tape T is cut automatically, the tape T is further sent by the length of a rear margin after completion of the printing operation, and then stopped, whereupon the cutter motor is driven to cut off the tape T. It should be noted that the tape printing apparatus 1 is provided with a cut key for enabling the user to manually cut the tape by key stroke, and it is possible to switch between an automatic cutting mode and a manual cutting mode. In the manual cutting mode, when the printing operation and additional feed of the tape are completed, the user depresses the cut key, whereby the tape cutter is actuated to cut off the tape T into a desired length.

The driving block 270 includes a display driver, a head driver, and a motor driver. The display driver drives the display 4 of the operating block 11 in response to control signals delivered from the control block 200, i.e. in accordance with commands carried by the signals. Similarly, the head driver drives the print head 7 of the printer block 12 in accordance with commands from the control block 200. Further, the motor driver has a TF motor driver for driving the TF motor of the printer block 12, and a cutter motor driver for driving the cutter motor of the cutter block 13, and drives each motor in accordance with commands from the control block 200.

Next, according to the tape printing apparatus 1, the user can removably mount the external memory (hereinafter referred to as the "file pack storage") 281 which is capable of storing a lot of document files and the like, as an auxiliary memory for use with a RAM 240, described hereinafter. The file pack storage 281 contains one or a plurality of (e.g. two) SRAMs (static RAMs), and is backed-up by batteries or the like, such that stored data can be preserved even when the file pack storage 281 is removed from the tape printing apparatus 1. Further, when the file pack storage 281 is mounted in a compartment of the external memory-mounting block 280, the file pack storage works such that it appears to the user to be part (e.g. one directory) of a memory area of the RAM 240, and is employed as a work area for carrying out the control process.

The operating block 11 includes the keyboard 3 and the display 4. The display 4 has a display screen 41 which is capable of displaying display image data e.g. of 198×64 dots on a rectangular display area of approximately 8 cm in the horizontal direction (X direction)×4 cm in the vertical direction (Y direction). The display 4 is used by the user when he enters data via the keyboard 3 to form or edit matrix data representative of a character string image in which images of characters, such as letters, numerals, symbols, simple figures, etc. are arranged or a print image including the character string image, view the result of such entry or edit of data, and enter various commands including selection commands via the keyboard 3.

On the keyboard 3, there are arranged a character key group 31 including an alphabet key group, not shown, a symbol key group (including a space key), not shown, a number key group, not shown, and a nonstandard character key group, not shown, for calling nonstandard characters for selection, as well as a function key group 32 for designating various operation modes. In a type of the apparatus 1 which is capable of entering the Japanese language, there is also provided a kana key group, not shown, for entering Japanese hiragana letters and Japanese katakana letters.

The function key group 32 includes a power key, not shown, a print key, not shown, for instructing a printing operation, a selection key, not shown, for finally determining entry of character data and starting new lines during text entry as well as determining selection of one of the various operating modes on a corresponding one of the selection screens, a color specification key, not shown, for specifying printing colors including neutral colors (mixed colors) of print image data, a color-setting key, not shown, for setting colors of characters and background colors, and four cursor keys (up arrow key, down arrow key, left arrow key, and right arrow key), not shown, for moving the cursor or the display range of print image data on the display screen 41 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of print image data and the size of display image data displayed on the image screen, a style key, not shown, for setting styles of labels to be formed, a file key, not shown, for handling files, an illustration key, not shown, for selecting background images, the cut key, not shown, for manually cutting the tape T, a nonstandard character key, not shown, for registering nonstandard characters, a conversion key, not shown, for carrying out conversion operations, such as kana-kanji conversion (in the case of a Japanese language-adapted type of the apparatus), a pack key, not shown, for initialization of the file pack storage 281 or changing the settings thereof, a format key, not shown, for setting formats for printing background patterns, and a preview print key, not shown, for use in instructing a preview print which enables the user to gain prior information about a print image as an ultimate result of printing.

Similarly to keyboards of the general type, the above key entries may be made by separate keys exclusively provided for respective key entries and/or by a smaller number of keys operated in combination with the shift key or the like. Here, for purposes of ease of understanding, the following description will be made assuming that there are provided as many keys as described above.

As shown in FIG. 1, from the keyboard 3, various commands and data described above are input to the control block 200.

The control block 200 includes a CPU 210, a ROM 220, a character generator ROM (CG-ROM) 230, a RAM 240, and an input/output control circuit (IOC) 250, all of which are connected to each other by an internal bus 260.

The ROM 220 has a control program area 221 storing control programs executed by the CPU 210 as well as a control data area 222 storing control data including a color conversion table, a character modification table, and the like. The CG-ROM 230 stores font data, i.e. data defining characters, symbols, figures and the like, provided for the tape printing apparatus 1. When code data identifying a character or the like is input thereto, it outputs the corresponding font data. In the type of the apparatus 1 which is capable of handling the Japanese language, the control data area 222 also stores a kana-kanji conversion table for converting Japanese hiragana letters into corresponding Japanese kanji letters.

The RAM 240 is backed-up such that stored data items can be preserved even when the power is turned off by operating the power key. The RAM 240 includes areas of a register group 241 for storing values of flags, etc., a text data area 242 for storing text data of characters or the like entered by the user via the keyboard 3, a display image data area 243 for storing image data displayed on the display screen 41, a print image data area 244 for storing print image data, a registered image data area 245 for storing registered image data, a nonstandard character registration image data area 246 for storing nonstandard character registration image data, a background image data area 247 for storing background image data as candidates for background images and character color data corresponding thereto, and buffer areas 248 including a character image-forming buffer, a color conversion buffer, color-by-color dithered image matrix-arranging buffers, a print buffer, and so forth. The RAM 240 is used as a work area for carrying out the control operation.

The IOC 250 incorporates a logic circuit for complementing the functions of the CPU 210 as well as dealing with interface signals for interfacing between the CPU 210 and peripheral circuits. The logic circuit is comprised of gate arrays, and custom LSI's. The IOC 250 also integrates the function of a timer for measuring elapsed time. The IOC 250 is connected to the sensors of the sensor block 14 and the keyboard 3, for receiving the signals generated by the sensor block 14 as well as commands and data entered via the keyboard 3, and inputting these to the internal bus 260 directly or after processing them. Further, the IOC 250 cooperates with the CPU 210 to deliver data and control signals input to the internal bus 260 by the CPU 210 or the like, to the driving block 270 directly or after processing them.

Further, the IOC 250 is connected to the external memory-mounting block 280 to control the input and output of data apparently carried out by accessing the RAM 240 but actually carried out by accessing the file pack storage 281, whereby when the file pack storage 281 is mounted in the compartment of the external memory-mounting block 280, the IOC 250 carries out control operations such that the RAM 240 appears to be expanded (the memory capacity of the RAM 240 appears to be increased) to the user (in handling files and the like). Therefore, in the following, unless otherwise specified, description is made assuming that the RAM 240 includes a memory capacity of the file pack storage 281, and that data stored in the file pack storage 281 is stored in the RAM 240 (although shown as the file pack storage 281 in FIG. 1 for purposes of clarify, actually, part or all of each of the above areas can be shared with the file pack storage 281).

The CPU 210 of the control block 200 receives the signals and data from the components of the tape printing apparatus 1 via the IOC 250, according to the control program read from the ROM 220, processes font data from the CG-ROM 230 and various data stored in the RAM 240 (including the file pack storage 281), as described above), and delivers signals and data to the components of the tape printing apparatus 1 via the IOC 250 to thereby carry out position control during printing operations, display control of the display screen 41, and print control for causing the print head 7 to carry out printing on the tape T under predetermined printing conditions. In short, the CPU 210 controls the overall operation of the tape printing apparatus 1.

Figure 2:
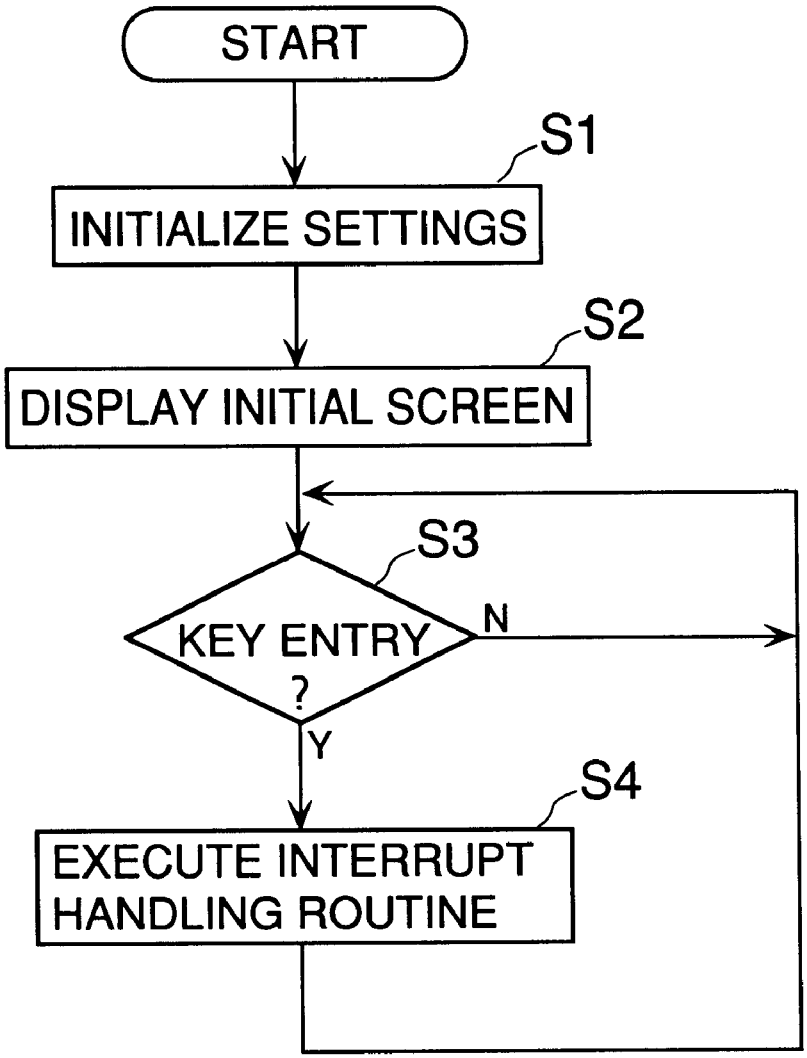
FIG. 2 is a flowchart showing a conceptual representation of an overall control process executed by the FIG. 1 tape printing apparatus.

Next, the overall control process carried out by the tape printing apparatus 1 will be described with reference to FIG. 2. As shown in the figure, when the program for carrying out the control process is started e.g. when the power key is depressed (the power of the tape printing apparatus 1 is turned on), first, at step S1, initialization of the system including restoration of saved control flags is carried out to restore the tape printing apparatus 1 to the state it was in before the power was turned off the last time. Then, the image that was displayed on the display screen 41 before the power was turned off the last time is shown as an initial screen at step S2. The following steps in FIG. 2, that is, step S3 for determining whether or not a key entry has been made and step S4 for carrying out an interrupt handling routine provide a conceptual representation of actual operations. Actually, when the initial screen has been displayed at step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations by the apparatus are carried out by interrupt handling routines, and hence if print image data for printing is provided or has been prepared, the user can print a print image based on the print image data at a desired time point, by depressing the print key or the preview print key to thereby generate an interrupt by the print key and start a printing process. In short, an operating procedure before the printing operation can be selected by the user as he desires.

In a narrow sense, the terms "display image" and "print image" mean a displayed image itself and a printed image itself, respectively, and the apparatus 1 deals with display image data representative of a display image and print image data representative of a print image. That is, although in the apparatus 1, an object to be subjected to processing, such as forming, modification, and registration is image data but not an image itself, for simplicity of the following description, "image data representing ?? image" is referred to as an "?? image" in the same manner that an image itself is referred to.

The tape printing apparatus and method according to the invention are implemented mainly by the control block 200, the operating block 11, and the printer block 12. Now, features of operations executed by the apparatus 1, more particularly "preview print" executed thereby will be described with reference to FIGS. 3 and 4. It should be noted that the "preview print" is intended to mean "printing an image formed by reducing the size of an actual print image on a tape so as to gain information about the ultimate result of a normal print prior to the normal print", while the "normal print" is intended to mean "printing the actual print image on a print medium desired by the user in a predetermined size set for the print medium".

Figure 3:
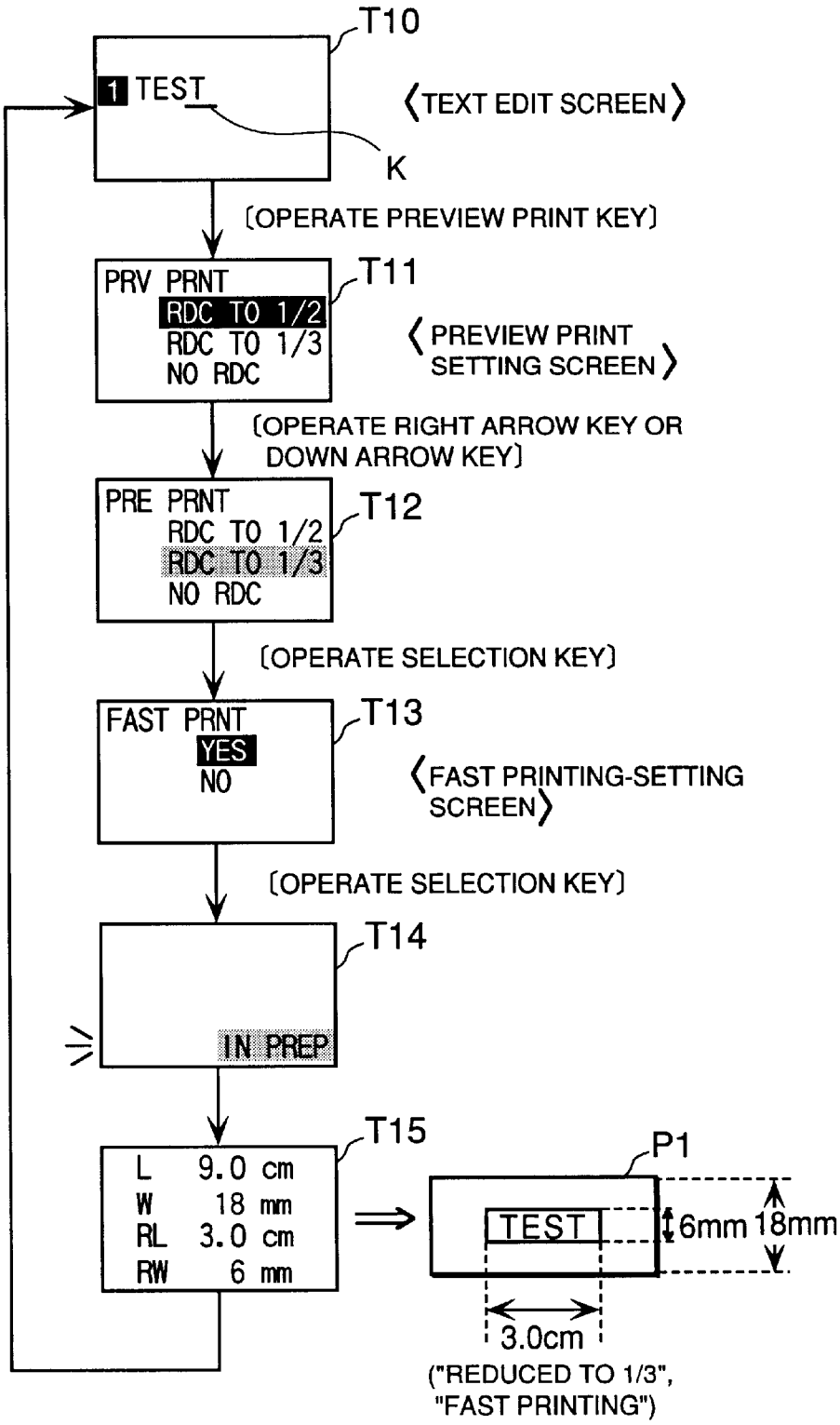
FIG. 3 is a diagram schematically showing an example of a sequence of display screens displayed during a preview print process, which is useful in explaining a typical operating procedure for execution of the process.

First, as shown in FIG. 3, when the print key is depressed (operated) by the user in a state of a character string "TEST" being entered on a "text edit screen" (screen T10: hereinafter, contents displayed on the display screen 41 of the display 4 are referred to as the "screen T??" (? represents a digit) and the reference numerals for the screens are shown only by T??, and a cursor position is indicated by K), the text edit screen is switched to a "preview print-setting screen", and "PRV PRNT" (preview print) is displayed in a heading area located at the top of the screen. Further, under the heading area, candidates for a reduction ratio are displayed, with a candidate "RDC TO ½" (reduced to ½) highlighted in reverse video (T11). Selection of a candidate is carried out by operating a cursor key. For instance, when the right arrow key or the down arrow key is depressed once, "RDC TO ⅓" (reduced to ⅓) is displayed in a shaded manner (T12). If the selection key is depressed in this state, the reduction ratio is set to ⅓, followed by the screen being switched to a "fast printing-setting screen" (T13).

In the "fast printing-setting screen", "FAST PRNT" (fast printing) is displayed in the heading area located at the top of the screen. Further, below the heading area, options "YES" and "NO" which are answers to whether fast printing is to be selected are displayed, with the option "YES"

highlighted in reverse video (T13). If the fast printing is not desired, "NO" is selected by operating a cursor key and displayed in the shaded manner, and then the selection key is depressed. Here, it is assumed that fast printing is desired. Therefore, the selection key is depressed in a state of the option "YES" being displayed in the shaded manner.

At this time, lengths of the tape required for the "normal print" and the "preview print" under preset conditions are calculated. During the calculation, a character string "IN PREP" (in preparation) is caused to blink on the screen (T14). When the calculation of the tape lengths is completed, the "preview print" is performed (P1). In the "preview print", as shown in the figure, an image of the character string "TEST" is printed together with a pair of horizontal parallel lines and a pair of vertical parallel lines arranged at upper, lower, right and left sides, respectively, to form the shape of a rectangle, such that a positional relationship between the pair of horizontal parallel lines, the pair of vertical parallel lines, and the character string "TEST" agrees with a positional relationship between the tape width, the tape length, and the character string in the normal print. The pair of horizontal lines indicative of a reduced tape width by a distance therebetween represent the tape width in the normal print, in a reduced size, and the pair of vertical lines indicative of a reduced tape length by a distance therebetween represent the tape length in the normal print, in a reduced size. The tape width, the tape length, and the character string are all reduced to their reduced sizes at the reduction ratio of ⅓, and the parallel lines and the character string are printed by fast printing executed with reduced print energy.

At the same time, not only the tape length ("L") required for the "normal print" (9.0 cm in the illustrated example) and the tape length ("RL") required for the "preview print" (3.0 cm in the illustrated example, which was obtained based on the predetermined reduction ratio ⅓) but also the tape width ("W") of a loaded tape T (18 mm in the illustrated example) and the tape width ("RW") required for the "preview print" (6 mm in the illustrated example, which was obtained based on the predetermined reduction ratio of ⅓) are all displayed on the screen (T15). In this connection, tape lengths to be displayed on the screen are obtained by rounding off the results of the calculation to the first decimal place (in centimeters), while tape widths are displayed in millimeters. After completion of the "preview print", the screen returns to the "edit screen" (T10).

Figure 4:
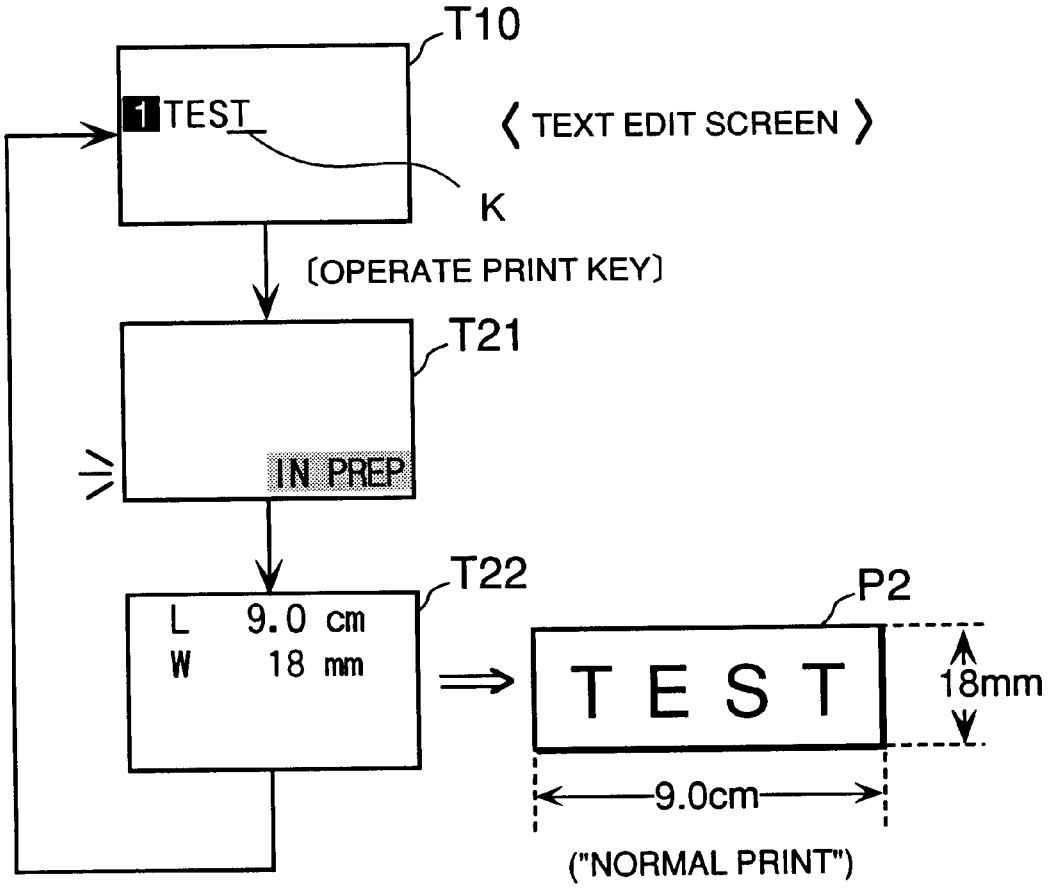
FIG. 4 is a diagram schematically showing an example of a sequence of display screens displayed during a normal print process, which is useful in explaining a typical operating procedure for execution of the process.
Figure 5:
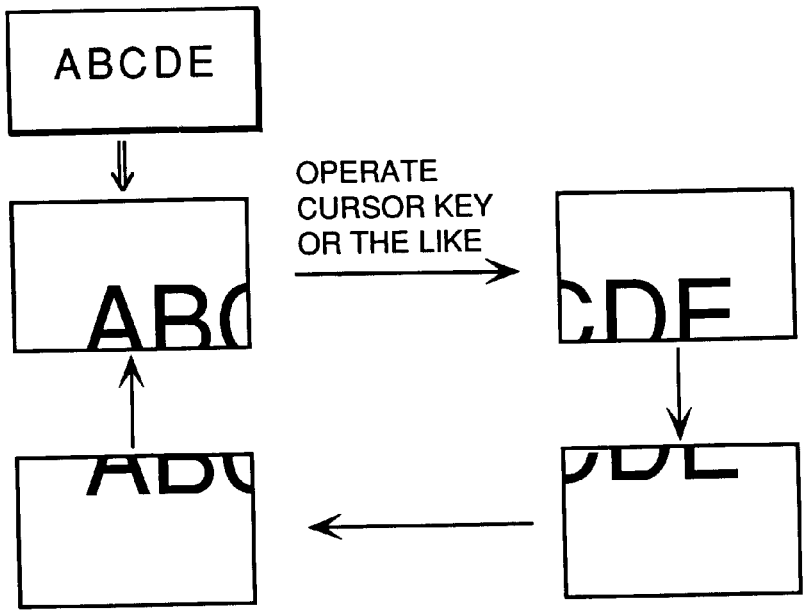
FIG. 5 is a diagram schematically showing an example of a sequence of display screens displayed when the user checks on a print image, which is useful in explaining a conventional method of gaining prior information about the print image as an ultimate result of printing.
Figure 6:
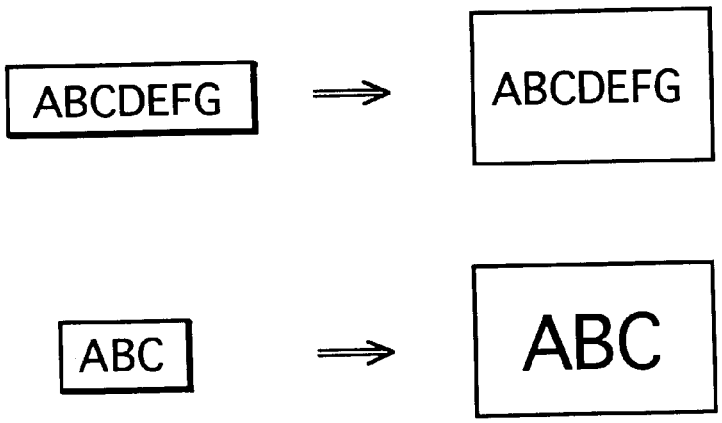
FIG. 6 is a diagram similar to FIG. 5, which is useful in explaining another conventional method of gaining prior information about a print image.

Then, when the result of the "preview print" is checked by the user and it is judged that there is no need to change the settings of printing or the like, the "normal print" is performed. As shown in FIG. 4, when the print key is depressed in the state of the "text edit screen" (T10) being displayed, the character string "IN PREP" blinks on the display screen 41, and then the tape length ("L") required for the "normal print" is calculated (T21). When the calculation is completed, the "normal print" is performed (P2), and the calculated tape length (9.0 cm in the illustrated example) for the "normal print" and the tape width ("W") (18 mm in the illustrated example) are displayed on the screen (T22). When the "normal print" is completed, the screen returns to the "text edit screen" (T10).

As described above, according to the present invention, in "preview print", a character string to be printed is printed in a reduced size together with a pair of horizontal parallel lines the distance between which is representative of a tape width and a pair of vertical parallel lines the distance between which is representative of a tape length, which form a rectangle enclosing the character string. Therefore, it is possible for the user to gain information of the whole of an image at a glance, which is as clear as possible and close to a final print image as an ultimate result of the normal print. Further, the "preview print" is performed by "fast printing", which makes it possible to gain information about the final print image quickly, and further, when an ink jet printing method is adopted, consumption of ink can be reduced.

Although in the "preview print" of the above embodiment, the character string and the two pairs of parallel lines representative of the tape width and the tape length are printed on the tape as a rectangle enclosing the character string, the character string may be printed together with only the pair of horizontal parallel lines or the pair of vertical parallel lines. In the case of only the pair of horizontal parallel lines being printed together with the character string, the distance between the horizontal parallel lines represent the tape width and the length of each horizontal line represents the tape length. In the case of only the pair of vertical parallel lines being printed together with the character string, the distance between the vertical parallel lines represents the tape length, and the length of each vertical line represents the tape width.

Further, each of the two pairs of parallel lines are only required to be partially in parallel with each other, and hence the two pairs of parallel lines are not necessarily required to form a rectangle (for instance, opposite ends of each of the lines may be bent to form four round corners).

Further, the two pairs of parallel lines may be dotted lines or wavy lines in place of solid lines. Additionally, the thickness of the lines may be partially changed.

Moreover, the two pairs of parallel lines are not necessarily required to be expressed as simple "lines", but they may be each expressed as a boundary between two different hatched or shaded portions or two different colors.

Further, when "print" is to be performed in color, "preview print" may be performed with a similar color arrangement. This enables the user to gain information not only of the layout of a character string, but also of the coloration of the same.

Although in the above embodiment, the reduction ratio is selected from the three options "reduction ½", "reduction ⅓", and "no reduction", the reduction ratio may be limited to a particular one (e.g. reduction ½), and selection may be carried out between "reduction" and "no reduction" before the "preview print" is started. Alternatively, the reduction ratio may be automatically set according to a sensed tape width.

Further, although in the embodiment, the character string "TEST" is printed as a print image on the tape as a print medium, a print image including a background pattern or one or more ruled lines may be printed. Still further, the whole or part of a label to be produced after the normal print may be regarded as a print image, and the print image may be reduced for "preview print".

It is further understood by those skilled in the art that the foregoing are preferred embodiments of the invention, and that various changes and modification may be made without departing from the spirit and scope thereof.

What is claimed is:

1. A tape printing apparatus that is capable of performing a normal print in which an entered character string is printed in a predetermined size on a tape as a print medium, the tape printing apparatus comprising:

tape width-detecting means for detecting a tape width of said tape;

reduction means for determining a reduced tape width by reducing said detected tape width at a predetermined reduction ratio and for forming a reduced character string by reducing said character string at said predetermined reduction ratio; and preview print means for printing a pair of parallel lines indicative of said reduced tape width and said reduced character string on said tape in a manner such that a positional relationship between said pair of parallel lines and said reduced character string agrees with a positional relationship between said tape and said character string in said normal print.

2. A tape printing apparatus according to claim 1, further comprising tape length-setting means for setting a tape length; and wherein said reduction means further determines a reduced tape length by reducing said tape length set by said tape length-setting means at said predetermined reduction ratio, and wherein said preview print means prints on said tape said pair of parallel lines indicative of said reduced tape width as upper and lower sides of a rectangle enclosing said reduced character string and a pair of parallel lines indicative of said reduced tape length as right and left sides of said rectangle.

3. A tape printing apparatus according to claim 1, further comprising color-setting means for setting colors of said character string and a background thereof; and wherein when said normal print is to be performed in color based on settings by said color-setting means, said preview print is performed with a color arrangement identical to a color arrangement in said normal print.

4. A tape printing apparatus according to claim 2, further comprising color-setting means for setting colors of said character string and a background thereof; and wherein when said normal print is to be performed in color based on settings by said color-setting means, said preview print is performed with a color arrangement identical to a color arrangement in said normal print.

5. A tape printing apparatus according to claim 1, further comprising color-setting means for setting colors of said character string and a background thereof; and wherein when said normal print is to be performed in color based on settings by said color-setting means, said colors of said character string and said background thereof in said normal print are monochromatically printed in gray tones in said preview print.

6. A tape printing apparatus according to claim 2, further comprising color-setting means for setting colors of said character string and a background thereof; and wherein when said normal print is to be performed in color based on settings by said color-setting means, said colors of said character string and said background thereof in said normal print are monochromatically printed in gray tones in said preview print.

7. A tape printing apparatus according to claim 1, wherein said preview print is performed with a lower print density and at a higher printing speed than said normal print is.

8. A tape printing apparatus according to claim 2, wherein said preview print is performed with a lower print density and at a higher printing speed than said normal print is.

9. A tape printing apparatus according to claim 3, wherein said preview print is performed with a lower print density and at a higher printing speed than said normal print is.

10. A tape printing apparatus according to claim 5, wherein said preview print is performed with a lower print density and at a higher printing speed than said normal print is.

11. A method of performing a preview print of an entered character string on a tape as a print medium, comprising the steps of:

detecting a tape width of said tape;

determining a reduced tape width by reducing said detected tape width at a predetermined reduction ratio;

forming a reduced character string by reducing said character string at said predetermined reduction ratio; and printing a pair of parallel lines indicative of said reduced tape width and said reduced character string on said tape in a manner such that a positional relationship between said pair of parallel lines and said reduced character string agrees with a positional relationship between said tape width and said character string printed in a predetermined size on said tape.

* * * * *